US012258199B2

(12) United States Patent
Machata et al.

(10) Patent No.: US 12,258,199 B2
(45) Date of Patent: Mar. 25, 2025

(54) APPARATUS, SYSTEM, AND METHODS FOR CLOSED FLUID DELIVERY

(71) Applicant: ERADOCATE, LLC, Mansfield, MA (US)

(72) Inventors: Matthew Machata, Mansfield, MA (US); Martin Johns, Mansfield, MA (US)

(73) Assignee: ERADOCATE, LLC, Mansfield, MA (US)

( * ) Notice: Subject to any disclaimer, the term of this patent is extended or adjusted under 35 U.S.C. 154(b) by 211 days.

(21) Appl. No.: 17/571,210

(22) Filed: Jan. 7, 2022

(65) Prior Publication Data

US 2022/0212853 A1 Jul. 7, 2022

Related U.S. Application Data

(60) Provisional application No. 63/134,877, filed on Jan. 7, 2021.

(51) Int. Cl.
*B65D 51/22* (2006.01)
*B65D 81/32* (2006.01)

(52) U.S. Cl.
CPC ..... *B65D 81/3205* (2013.01); *B65D 51/222* (2013.01)

(58) Field of Classification Search
CPC ..... B65D 51/222; B65D 81/3205
See application file for complete search history.

(56) References Cited

U.S. PATENT DOCUMENTS

| | | | | |
|---|---|---|---|---|
| 6,629,599 | B2 | 10/2003 | Sperry et al. | B65D 81/32 |
| 2010/0084361 | A1* | 4/2010 | Dayton | B31C 9/00 493/93 |
| 2013/0072893 | A1 | 3/2013 | Takemoto | A61J 1/20 |
| 2017/0129666 | A1 | 5/2017 | Smith | B65D 51/28 |

FOREIGN PATENT DOCUMENTS

| | | |
|---|---|---|
| WO | WO2007/134392 | 11/2007 |

OTHER PUBLICATIONS

International Search Report and Written Opinion issued in PCT Application No. PCT/US22/11679, dated Apr. 1, 2022, 11 pgs.

* cited by examiner

*Primary Examiner* — Paul J Gray
(74) *Attorney, Agent, or Firm* — HAYES SOLOWAY P.C.

(57) ABSTRACT

A system, apparatus, and method for closed fluid delivery include a bottle holding a quantity of fluid. A membrane is positioned over an opening of the bottle to seal the fluid therein. A closed fluid delivery adapter has a first portion with a first mateable end connectable to the bottle along the opening of the bottle and a second portion having a second mateable end positioned to connect to a container. A fluid pathway is between the first and second portions. A puncturing structure is positioned along the fluid pathway. A removable collar is positioned between the first and second portions. The removable collar prevents the first and second portions from moving closer together. Upon removal of the removable collar, the first and second portions are movable closer together, whereby the puncturing structure punctures the membrane to allow flow of the fluid.

9 Claims, 8 Drawing Sheets

APPARATUS, SYSTEM, AND METHODS FOR CLOSED FLUID DELIVERY

CROSS REFERENCE TO RELATED APPLICATION

This application claims benefit of U.S. Provisional Patent Application Ser. No. 63/134,877 entitled, "Apparatus, system, and methods for closed fluid delivery" filed Jan. 7, 2021, the entire disclosure of which is incorporated herein by reference.

FIELD OF THE DISCLOSURE

The present disclosure is generally related to fluid delivery devices and methods, and more particularly is related to an apparatus, system, and methods for closed fluid delivery.

BACKGROUND OF THE DISCLOSURE

Certain fluids, such as chemicals, medications, and food products, are often transported in concentrated form to save on transportation and shipping costs, as well as to save space in storage. When the product is needed by the end user, he or she can dilute the fluid to water or another substance which is readily available, such that the product reaches its usable form. With some fluids, it can be crucially important to ensure that all of the concentrated material is correctly and accurately diluted into a specific quantity of non-concentrated fluid. Without accurate dilution, the end product may be inferior. As an example, beverage syrups used in commercial restaurants must be correctly mixed with carbonated water to ensure the beverage tastes as intended. While there are many fluid delivery systems conventionally available to ensure concentrated fluids are correctly diluted, certain concentrated fluid chemicals require specific delivery systems which ensure the fluid can be handled correctly and safely when diluting.

Thus, a heretofore unaddressed need exists in the industry to address the aforementioned deficiencies and inadequacies.

SUMMARY OF THE DISCLOSURE

Embodiments of the present disclosure provide a system, apparatus, and method for closed fluid delivery. Briefly described, in architecture, one embodiment of the system, among others, can be implemented as follows. The apparatus for closed fluid delivery has a bottle capable of holding a quantity of fluid. A membrane is positioned over an opening of the bottle. The membrane is positioned to seal the quantity of fluid within an interior of the bottle. A closed fluid delivery adapter has a first portion having a first mateable end connectable to the bottle along the opening of the bottle, and a second portion having a second mateable end positioned to connect to a container. A fluid pathway is between the first and second portions and a puncturing structure is positioned along the fluid pathway. A removable collar is positioned at least partially between the first and second portions, wherein the removable collar prevents the first and second portions from moving closer together. Upon removal of the removable collar, the first and second portions are movable closer together, whereby the puncturing structure punctures the membrane, thereby allowing the quantity of fluid to flow from the bottle and through the closed fluid delivery adapter and into the container.

The present disclosure can also be viewed as providing a closed fluid delivery adapter apparatus. Briefly described, in architecture, one embodiment of the apparatus, among others, can be implemented as follows. A first portion has a first mateable end connectable to a bottle along an opening of the bottle. A second portion has a second mateable end positioned to connect to a container. A fluid pathway is between the first and second portions. A puncturing structure is positioned along the fluid pathway. A removable collar is positioned at least partially between the first and second portions, wherein the removable collar prevents the first and second portions from moving closer together, and wherein, upon removal of the removable collar, the first and second portions are movable closer together, whereby the puncturing structure punctures a membrane, thereby allowing the quantity of fluid to flow from the bottle and through the closed fluid delivery adapter and into the container.

The present disclosure can also be viewed as providing a method for closed fluid delivery. In this regard, one embodiment of such a method, among others, can be broadly summarized by the following steps: providing a bottle holding a quantity of fluid; positioning a membrane over an opening of the bottle, wherein the membrane seals the quantity of fluid within an interior of the bottle; attaching a closed fluid delivery adapter to the bottle, wherein the closed fluid delivery adapter has: a first portion having a first mateable end connectable to the bottle along the opening of the bottle; a second portion having a second mateable end positioned to connect to a container; a fluid pathway between the first and second portions; a puncturing structure positioned along the fluid pathway; and a removable collar positioned at least partially between the first and second portions, wherein the removable collar prevents the first and second portions from moving closer together; removing the removable collar from the closed fluid delivery adapter; and moving the first and second portions closer together, thereby causing the puncturing structure to puncture the membrane, thereby allowing the quantity of fluid to flow from the bottle and through the closed fluid delivery adapter and into the container.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
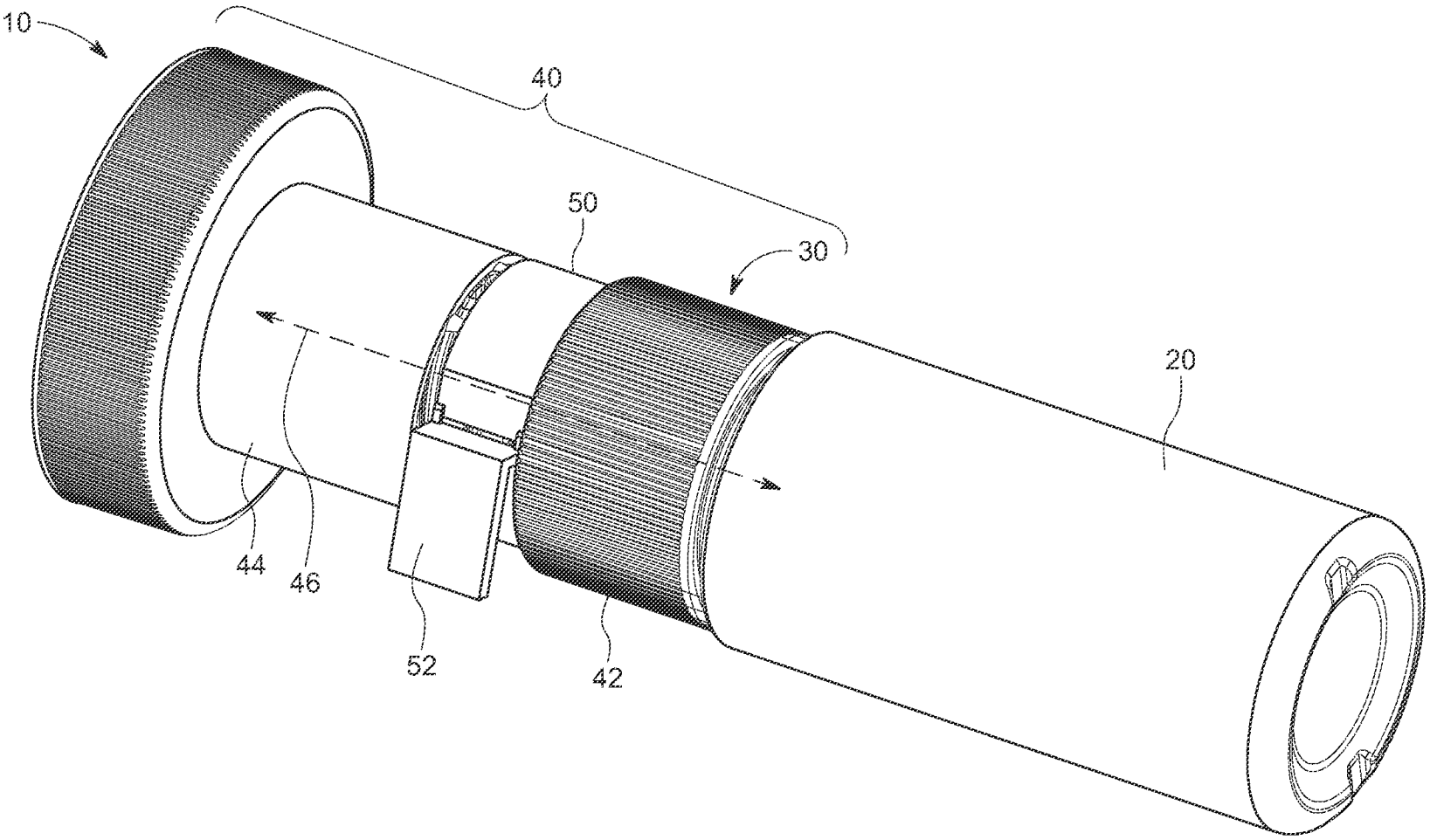
FIG. 1 is a plan view illustration of a closed fluid delivery apparatus, in accordance with a first exemplary embodiment of the present disclosure.
Figure 2:
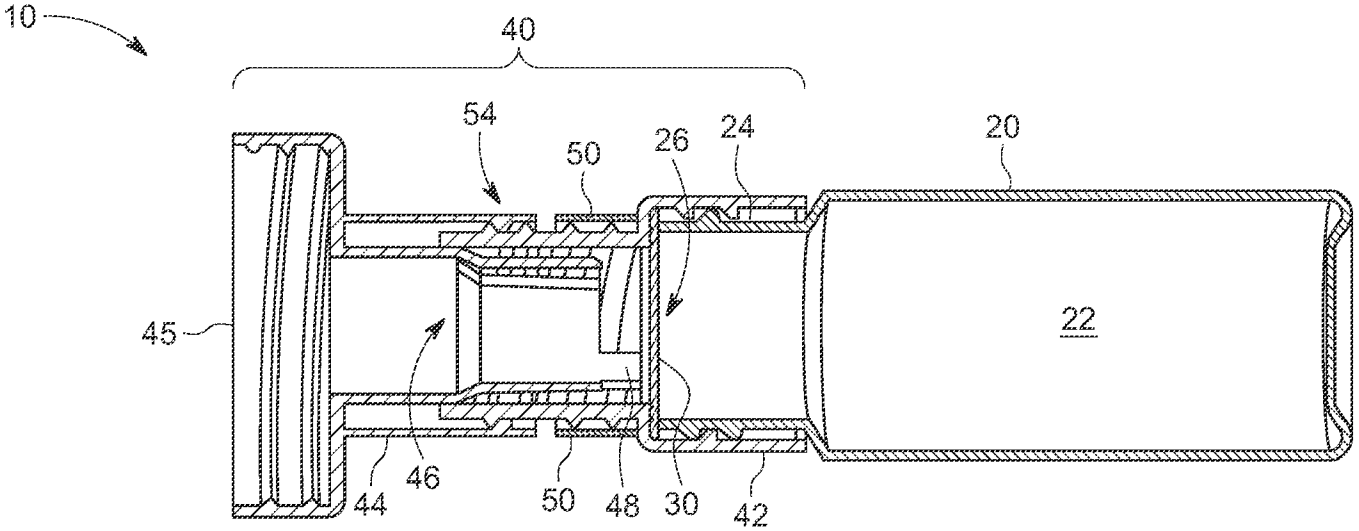
FIG. 2 is a cross-sectional illustration of the closed fluid delivery apparatus of FIG. 1, in accordance with the first exemplary embodiment of the present disclosure.
Figure 3:
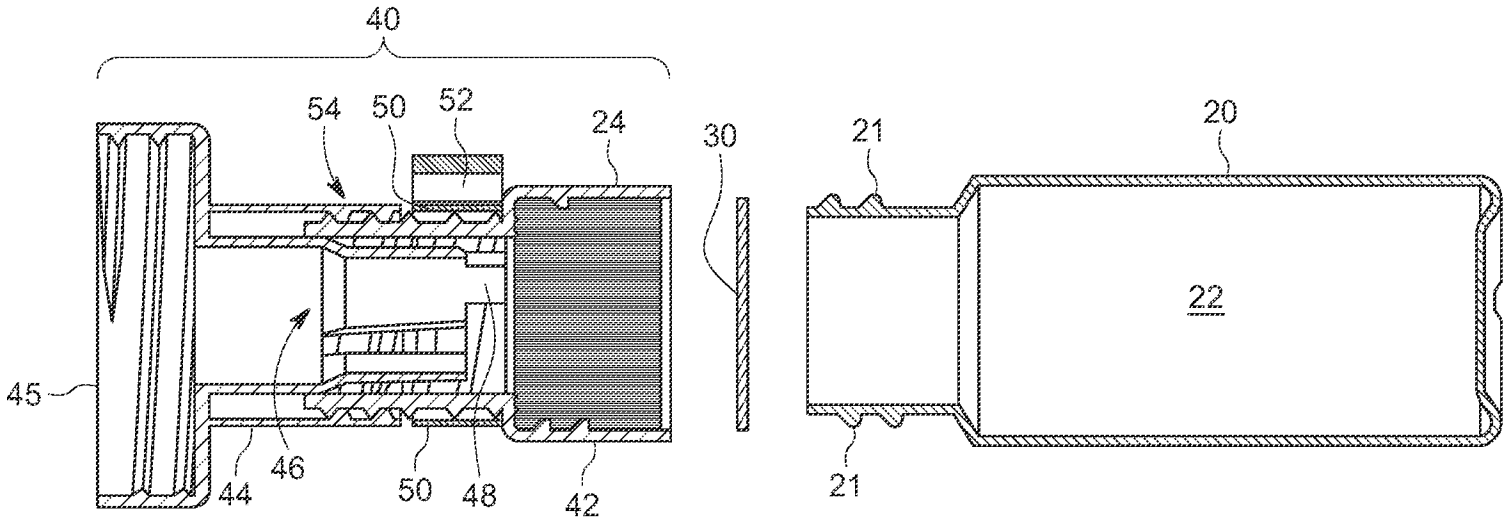
FIG. 3 is an exploded view, cross-sectional illustration of the closed fluid delivery apparatus of FIG. 1, in accordance with the first exemplary embodiment of the present disclosure.

To improve upon the shortcomings identified herein, the subject disclosure is directed to a closed fluid delivery apparatus which allows for the accurate and safe transfer of a fluid, such as a concentrated chemical, into a separate container for dilution or otherwise. FIG. 1 is a plan view illustration of the closed fluid delivery apparatus 10, in accordance with a first exemplary embodiment of the present disclosure. FIG. 2 is a cross-sectional illustration of the closed fluid delivery apparatus 10 of FIG. 1, in accordance with the first exemplary embodiment of the present disclosure. FIG. 3 is an exploded view, cross-sectional illustration of the closed fluid delivery apparatus 10 of FIG. 1, in accordance with the first exemplary embodiment of the present disclosure.

With reference to FIGS. 1-3 together, the closed fluid delivery apparatus 10, which may be referred to herein as 'apparatus 10' includes a bottle 20 capable of holding a quantity of fluid (not shown) within an interior 22 thereof. The bottle 20 may be formed from any material or structure capable of containing fluid. For instance, the bottle 20 is commonly formed from a molded plastic material to create a structure having the interior 22 space for holding fluid, whereby the fluid is dispensable from the bottle 20 through a neck 24 of the bottle 20 having threads 21 or similar structures for mating the bottle 20 to another structure using a removable connection. The bottle 20 may have any size, interior or exterior, and may, in some instances, include multiple compartments or similar arrangements.

A membrane 30 is positioned over an opening 26 of the bottle 20 and acts as a seal for the bottle 20, thereby sealing any contents within the interior 22 of the bottle 20 therein. In particular, the membrane 30 may be formed from a breathable material, such as that sold under the trademark GORE-TEX®, which allows the passage of air and similar gasses, but prevents the passage of fluid therethrough, such that the membrane 30 seals fluid within the interior 22 of the bottle 20 yet allows gas and air within the bottle 20 to dissipate or equalize with an exterior atmosphere. Not only does the membrane 30 prevent the fluid from inadvertently flowing out of the bottle 20, but it ensures the bottle does not suffer from a structural failure due to the expansion of pressure of the liquid within the interior 22 of the bottle 20.

The ability for the seal 30 to allow the release of air and similar gasses may be a particularly important consideration for when the bottle 20 contains a fluid chemical which gives off gasses and other materials which must be allowed to evacuate to the outside atmosphere. Without use of a membrane 30 or similar valve or breathable port, the fluid within the bottle 20 may expand until it ruptures the sidewall of the bottle 20 or a cap positioned on the bottle 20. In a similar situation, the ability for the seal 30 to allow breathing of the fluid within the interior 22 of the bottle 20 may be useful for when the bottle 20 experiences changing temperatures, which can alter a pressure within the interior 22 of the bottle 20. When the fluid is a non-expanding fluid, in a different example, the membrane 30 may be formed from a non-breathable material which does not allow the passage of gas or air.

A closed fluid delivery adapter 40 (simply referred to as 'adapter 40') is an assembly of components which together are connectable to the bottle 20 along the opening 26 thereof, such as by connection to the threads 21 positioned proximate to the opening 26 of the bottle 20. In this position, the membrane 30 may be positioned between the bottle 20 and the adapter 40. In greater detail, as shown in FIGS. 2-3, the adapter 40 has a first portion 42 which includes a first mateable end connectable to the bottle 20 along the opening 26. In one example, as depicted in FIGS. 1-3, the first mateable end includes interior threading which is sized to mate with the exterior threading 21 on the neck 24 of the bottle 20. Other forms of mateable connections may also be used, such as friction connections, slip connections, or other mechanical interfaces which are generally fluid-tight.

The adapter 40 includes a second portion 44 which is selectively movable relative to the first portion 42, as discussed in greater detail in the following passages. The second portion 44 has a second mateable end 45 which is positioned to connect to a container (not shown) and may have larger interior threading which can be engaged with the exterior threading on the container, such as a bottle or other conventional container used for fluid delivery. In one example, where the bottle 20 contains a concentrated fluid chemical, the container which connects to the second mateable end 45 may be sized larger than the bottle 20, for example, such that the container is approximately 1-5 gallons in size whereas the bottle 20 has a volume of substantially less than one gallon.

In the middle of the adapter 40, i.e., along a central axis of the adapter 40, there is a fluid pathway 46 formed between the first and second portions 42, 44, which allows for the fluid from the bottle 20 to flow through the fluid pathway 46 and into the container which is connectable to the second mateable end 45 of the second portion 44. The fluid pathway 46 may have any shape or size which allows the flow of fluid therethrough. Within or along the fluid pathway 46 is one or more puncturing structures 48 which are positioned to be proximate to the membrane 30 sealed over the opening 26 of the bottle 20. The puncturing structure 48 may be, in one example, a terminating end of one or more structures forming the fluid pathway 46 which are sharpened or otherwise formed such that they are able to puncture, break, or otherwise remove the membrane 30 when desired. The specific design of the puncturing structure 48 may be selected based on the type of material the membrane 30 is formed from, such that certain materials may require sharp puncturing structures 48 whereas other materials may only require a blunt end of the puncturing structure 48 to force through the membrane 30. As shown in the figures, the puncturing structures 48 may be positioned interiorly of the outer walls of both of the first and second portions 42, 44.

The adapter 40 further includes a removable collar 50 which is positioned at least partially between the first and second portions 42, 44. As shown in FIG. 1 in detail, the removable collar 50 may be substantially cylindrical in shape such that it traverses fully or partially around the adapter 40. The removable collar 50 may also have a protruding tab 52, as best shown in FIG. 3, which extends circumferentially outwards from the body of the removable collar 50 and the adapter 40 such that a user can grasp the protruding tab 52. When the removable collar 50 is in place on the adapter 40, as shown in FIGS. 1-3, it prevents the first and second portions 42, 44 from moving closer together by acting as a structural stop which prevents interiorly biased movement.

However, when the tab 52 is pulled with sufficient force, the removable collar 50 may be separated from the adapter 40 and pulled away, partially or entirely. When this occurs, the first and second portions 42, 44 are now adjustably movable relative to one another, such that a user is able to move the first and second portions 42, 44 together towards one another or away from one another, in a direction along a central axis of the adapter 40. For instance, this movement of the first and second portions 42, 44 closer together may be achieved by rotating one of the bottle 20 or the adapter 40 relative to the other, where this rotational movement translates into linear movement of one or both structures, causing mateable threading 54 positioned along the fluid pathway 46 to move the structures closer together. After the first and second portions 42, 44 are moved a sufficient distance, the puncturing structure 48 contacts and punctures the membrane 30, such that fluid from within the bottle 20 can flow from the bottle 20 and through the adapter 40 and into a container attached to the second portion 44.

Figure 4:
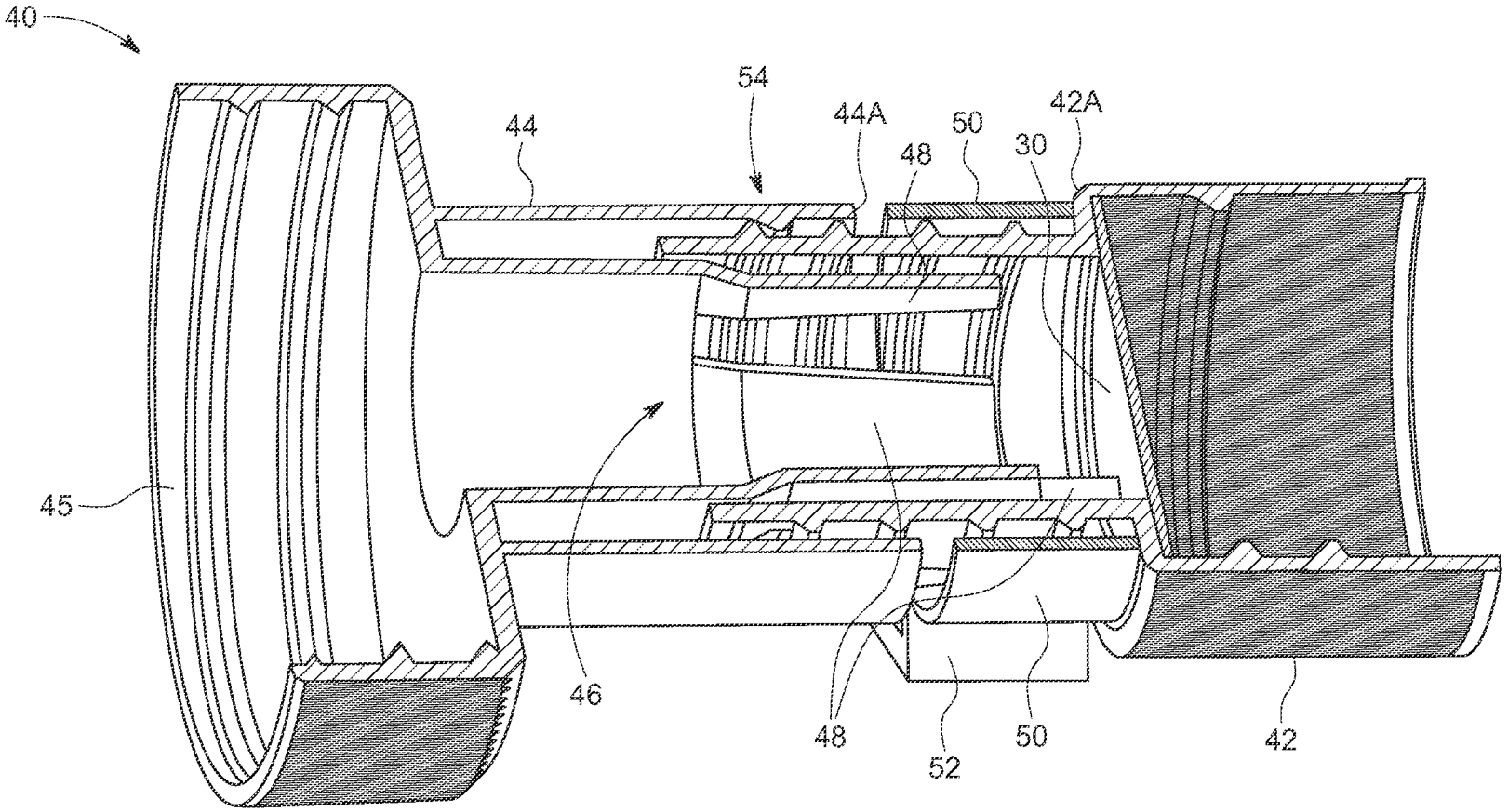
FIG. 4 is a cross-sectional illustration of the fluid adapter of the closed fluid delivery apparatus of FIG. 1, in accordance with the first exemplary embodiment of the present disclosure.

FIG. 4 is a cross-sectional illustration of the fluid adapter 40 of the closed fluid delivery apparatus 10 of FIG. 1, in accordance with the first exemplary embodiment of the present disclosure. In FIG. 4, the details of the threading 54 between the first and second portions 42, 44 can be seen in detail. These threadings 54 allow for the first and second portions 42, 44 to mate with one another and be movable relative to one another when the removable collar 50 is removed from the adapter 40, such that the interior terminating ends 42A, 44A of the first and second portions 42, 44 can move closer together, or contact one another. However, when the removable collar 50 is in place, as shown in FIG. 4, the physical structure of the removable collar 50 prevents the interior terminating ends 42A, 44A of the first and second portions 42, 44 from moving towards one another. This prevents the puncturing structure 48 from contacting the membrane 30.

Figure 5:
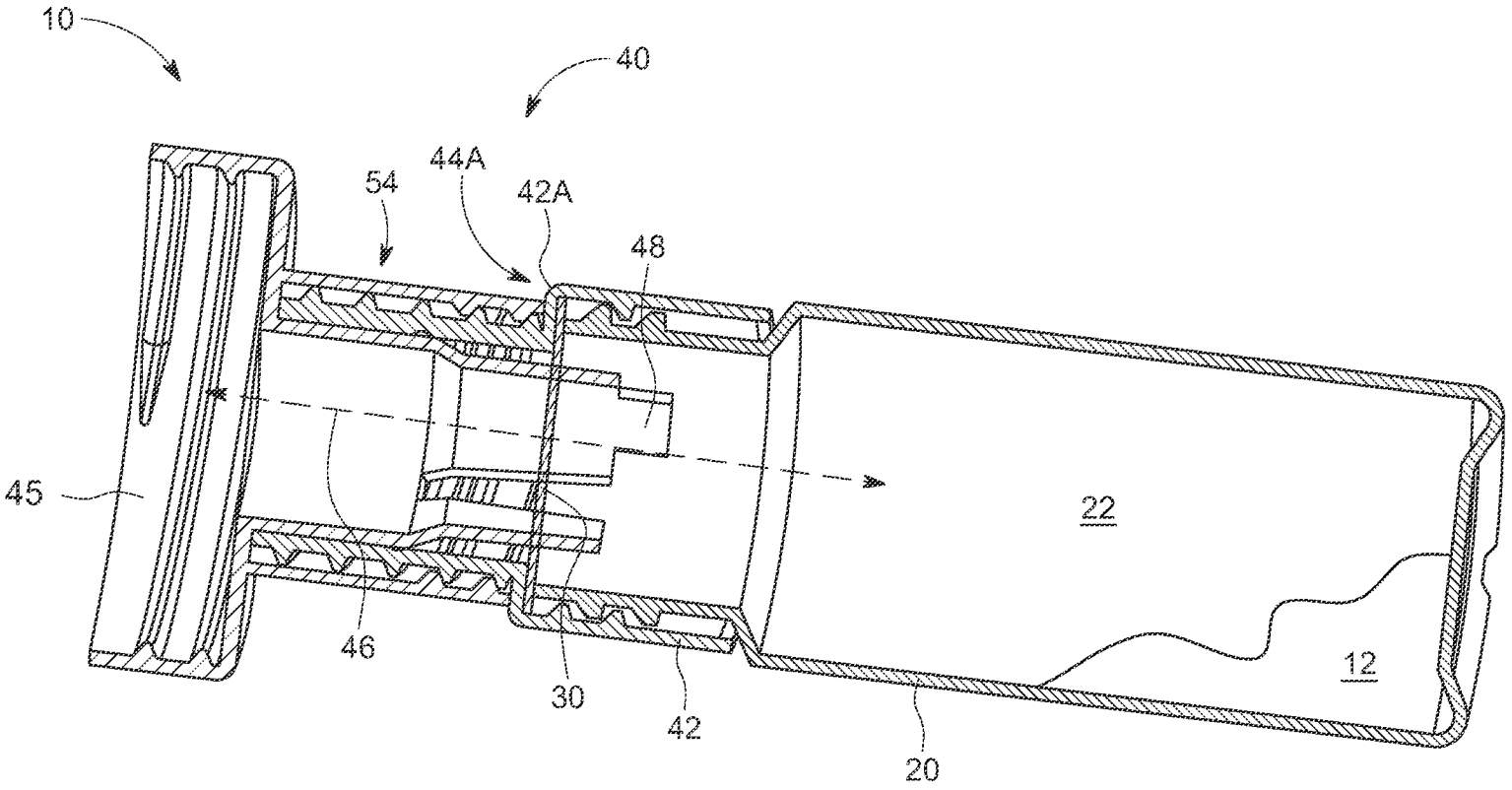
FIG. 5 is a cross-sectional illustration of the closed fluid delivery apparatus of FIG. 1 in an activated position, in accordance with the first exemplary embodiment of the present disclosure.

As shown in FIG. 5, which is a cross-sectional illustration of the closed fluid delivery apparatus 10 of FIG. 1 in an activated position, in accordance with the first exemplary embodiment of the present disclosure, the removable collar 50 has been removed from the adapter 40 and the first and second portions 42, 44 have moved closer to one another. As shown, the interior terminating ends 42A, 44A are substantially in contact. When this position is achieved, the puncturing structures 48 are moved towards the bottle 20 where they make contact with the membrane 30 and pierce or otherwise break the membrane 30. This unseals the interior 22 of the bottle 20, thereby allowing fluid 12 therein to move along the fluid path 46 through the adapter 40, as indicated by the broken arrow.

When a container is connected to the second mateable end 45 of the second portion 44 of the adapter 40, and the user orients the apparatus 10 in a position where the opening of the bottle 20 is substantially facing downwards, the fluid 12 can flow through the fluid passage 46 and mix with any fluid within the container. Similarly, any fluid within the container can also be flowed through the fluid passage 46 to enter the bottle 20 and mix with the fluid 12 therein. In this way, the apparatus 10 allows for fluid delivery of the fluid 12 to the container in a closed system where the fluid cannot spill or otherwise leak from the bottle 20 during delivery, and where possible contaminants in the air or surrounding atmosphere cannot gain access to the interior of the bottle 20 or container. This helps ensure that the correct volume of fluid 12 from the bottle 20 is accurately delivered to the container. It also helps ensure the safety of the individual or individuals handling the fluid 12 during delivery.

Figure 6:
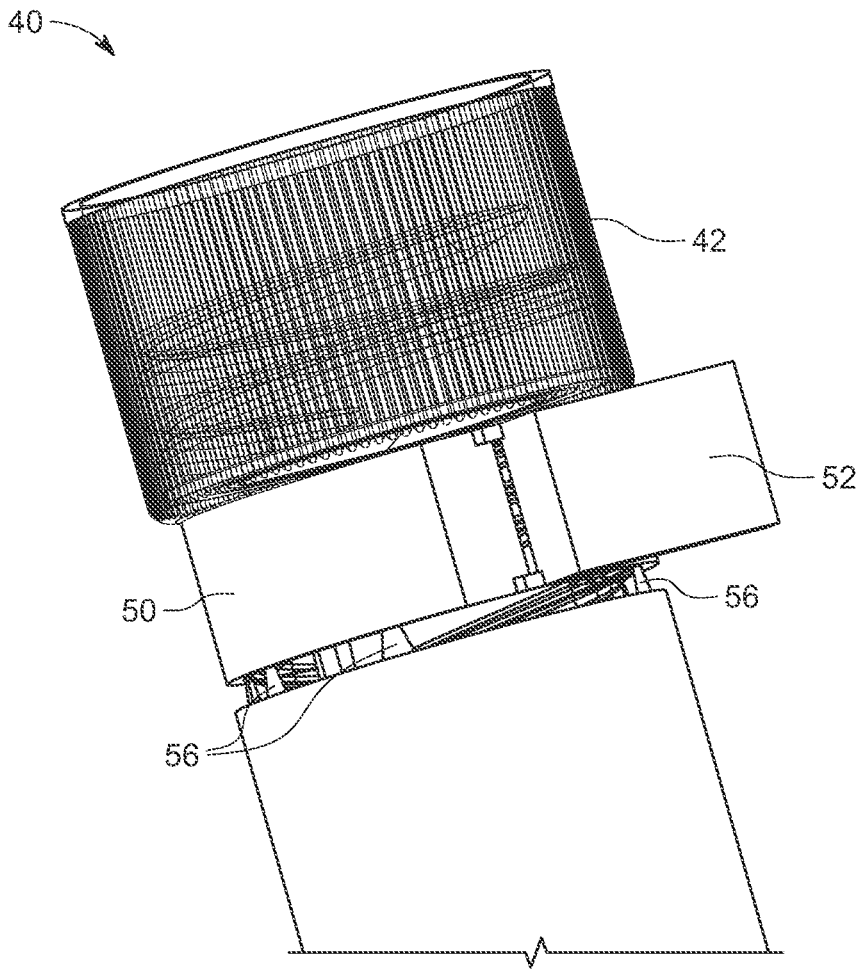
FIGS. 6-7 are various illustrations of the removable collar of the closed fluid delivery apparatus of FIG. 1, in accordance with the first exemplary embodiment of the present disclosure.
Figure 7:
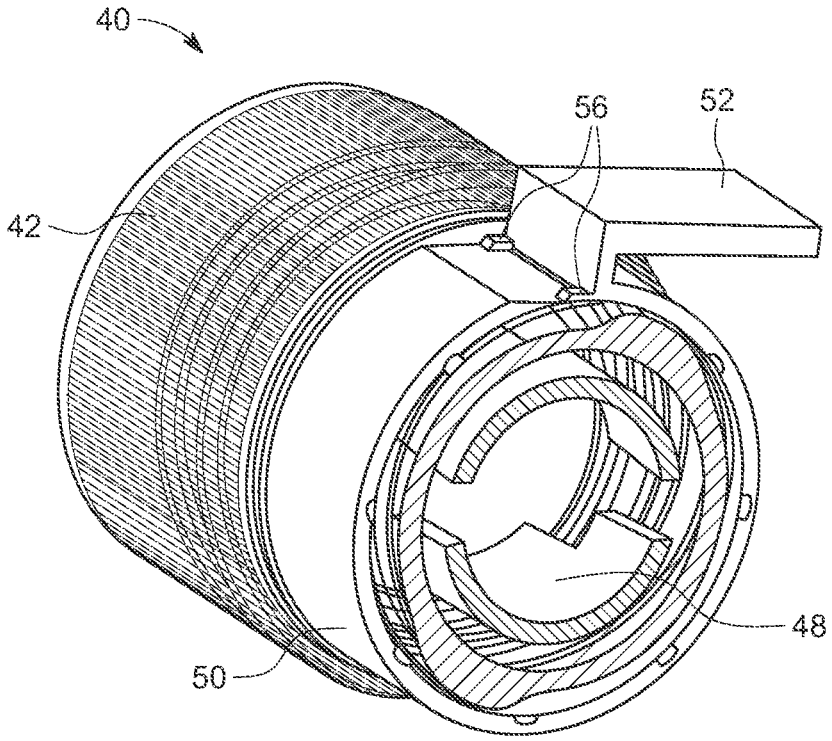

To provide greater details of the removable collar 50, FIGS. 6-7 are various illustrations of the removable collar 50 of the closed fluid delivery apparatus 10 of FIG. 1, in accordance with the first exemplary embodiment of the present disclosure. As shown in FIGS. 6-7, the removable collar 50 may be structurally attached to the adapter 40 through the use of small connectors 56 which extend between two portions of the removable collar 50, or between the removable collar 50 and the sidewall of the adapter 40. For instance, as shown in FIGS. 6-7, the small connectors 56 may be connected between a part of the collar 50 where the tab 52 is located, and an opposing end of the collar 50 which is in near proximity to the tab 52, such that the small connectors 56 maintain the collar 50 in an annular position on the adapter 40.

These small connectors 56 may be sufficient to retain the removable collar 50 in place until the tab 52 is pulled with sufficient force, at which point the small connectors 56 may break to allow the removable collar 50 to separate from the adapter 40. Accordingly, the small connectors 56 may be durable enough to prevent inadvertent removal of the collar 50, yet capable of breaking or releasing when a user desires to remove the collar 50. The size, position, and specific construction of the small connectors 56 may depend on the material and construction of the collar 50, but it may be common for the collar 50, the tab 52, and the small connectors 56 to be formed from the same material, often a molded plastic material. In this example, the small connectors 56 can be formed as small, bridging portions of the material which are sized small enough to break with a sufficient pulling force on the tab 52.

Figure 8:
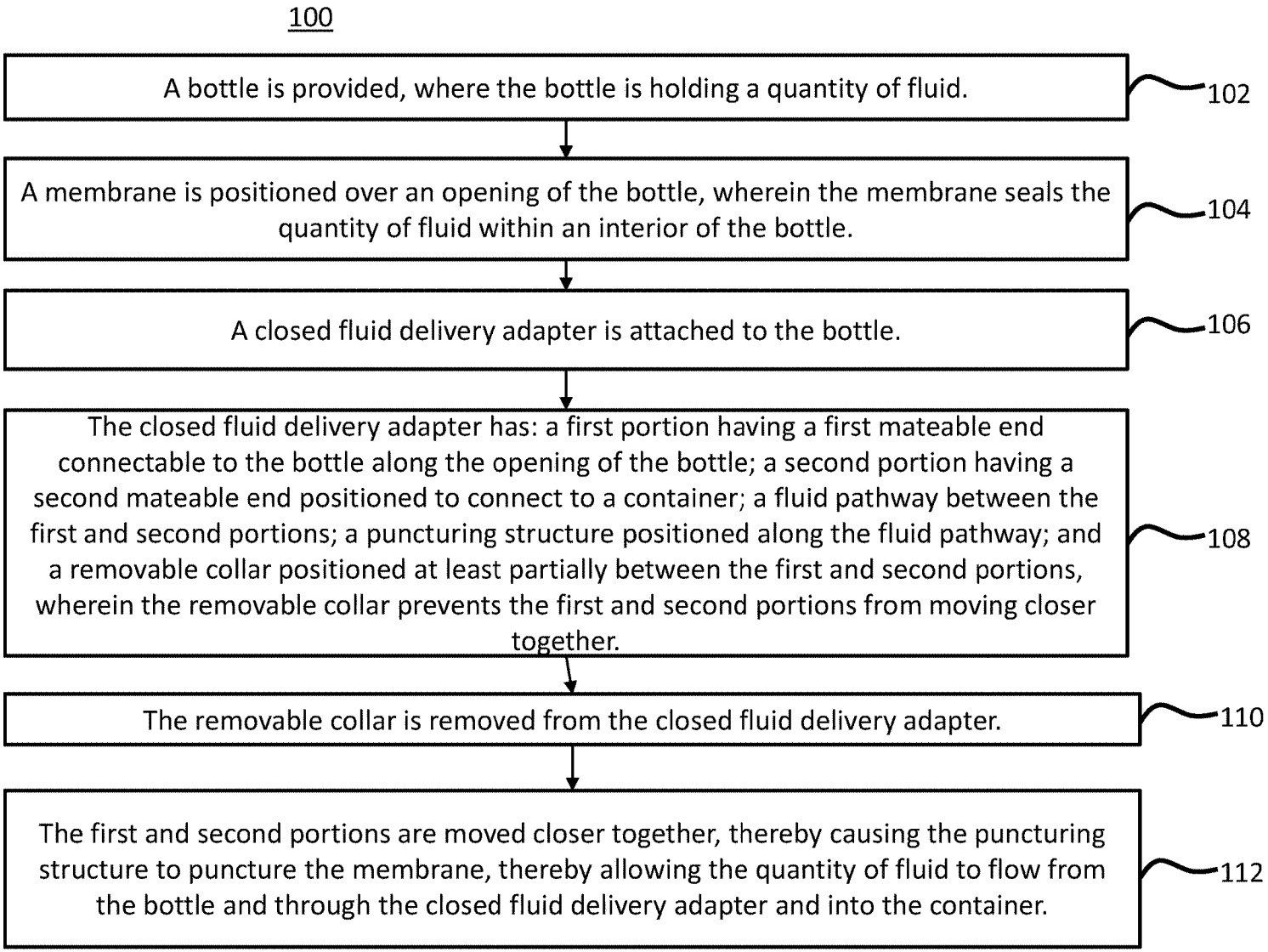
FIG. 8 is a flowchart illustrating a method for closed fluid delivery, in accordance with the first exemplary embodiment of the disclosure.

FIG. 8 is a flowchart 100 illustrating a method for closed fluid delivery in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a bottle is provided, where the bottle is holding a quantity of fluid. A membrane is positioned over an opening of the bottle, wherein the membrane seals the quantity of fluid within an interior of the bottle (block 104). A closed fluid delivery adapter is attached to the bottle (block 106). The closed fluid delivery adapter has: a first portion having a first mateable end connectable to the bottle along the opening of the bottle; a second portion having a second mateable end positioned to connect to a container; a fluid pathway between the first and second portions; a puncturing structure positioned along the fluid pathway; and a removable collar positioned at least partially between the first and second portions, wherein the removable collar prevents the first and second portions from moving closer together (block 108). The removable collar is removed from the closed fluid delivery adapter (block 110). The first and second portions are moved closer together, thereby causing the puncturing structure to puncture the membrane, thereby allowing the quantity of fluid to flow from the bottle and through the closed fluid delivery adapter and into the container (block 112). Any number of additional steps, functions, processes, or variants thereof may be included in the method, including any disclosed relative to any other figure of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claim.

What is claimed is:

1. A closed fluid delivery adapter apparatus comprising:

a first portion having a first mateable end connectable to a bottle along an opening of the bottle, the first portion having a sidewall extending away from the first mateable end;

a second portion in communication with the first portion, the second portion having a second mateable end extending away from the first portion, wherein the second mateable end is positioned to removably connect to a container, wherein the container is a separate vessel from the bottle, and wherein the second portion has an inner sidewall positioned along the fluid pathway and an outer sidewall positioned along an exterior surface of the second portion, wherein a gap is formed in a space between the inner and outer sidewalls;

a fluid pathway extending between the first and second portions;

threads formed on at least the sidewall of the first portion positioned along the fluid pathway;

a puncturing structure connected to the inner sidewall of the second portion positioned along the fluid pathway, and extending towards the first portion; and a removable collar positioned at least partially between the first and second portions, wherein the removable collar prevents the first and second portions from moving closer together, and wherein, upon removal of the removable collar, the first and second portions are movable closer together, to a position where the threads formed on the sidewall of the first portion are positioned within the gap formed between the inner and outer sidewalls of the second portion, and the puncturing structure punctures a membrane, thereby allowing a quantity of fluid to flow from the bottle and through the closed fluid delivery adapter and into the container.

2. The closed fluid delivery adapter apparatus of claim 1, wherein the first and second portions are movable closer together by a rotation of the first portion relative to the second portion.

3. The closed fluid delivery adapter apparatus of claim 1, wherein the first and second portions are movable closer together until interior terminating ends of the first and second portions are in contact.

4. The closed fluid delivery adapter apparatus of claim 1, wherein the removable collar has a protruding tab, wherein the protruding tab extends circumferentially outwards from the removable collar.

5. An apparatus for closed fluid delivery comprising:

a bottle capable of holding a quantity of fluid;

a membrane positioned over an opening of the bottle, the membrane positioned to seal the quantity of fluid within an interior of the bottle; and a closed fluid delivery adapter having:

a first portion having a first mateable end connectable to the bottle along the opening of the bottle, the first portion having a sidewall extending away from the first mateable end;

a second portion in communication with the first portion, the second portion having a second mateable end extending away from the first portion, wherein the second mateable end is positioned to removably connect to a container, wherein the container is a separate vessel from the bottle, and wherein the second portion has an inner sidewall positioned along the fluid pathway and an outer sidewall positioned along an exterior surface of the second portion, wherein a gap is formed in a space between the inner and outer sidewalls;

a fluid pathway extending between the first and second portions;

threads formed on at least the sidewall of the first portion positioned along the fluid pathway;

a puncturing structure connected to the inner sidewall of the second portion positioned along the fluid pathway, and extending towards the first portion; and a removable collar positioned at least partially between the first and second portions, wherein the removable collar prevents the first and second portions from moving closer together, and wherein, upon removal of the removable collar, the first and second portions are movable closer together to a position where the threads formed on the sidewall of the first portion are positioned within the gap formed between the inner and outer sidewalls of the second portion, and the puncturing structure punctures the membrane, thereby allowing the quantity of fluid to flow from the bottle and through the closed fluid delivery adapter and into the container.

6. The apparatus for closed fluid delivery of claim 5, wherein the membrane allows the passage of air and gasses but prevents the passage of fluid.

7. The apparatus for closed fluid delivery of claim 5, wherein the first and second portions are movable closer together by a rotation of the first portion relative to the second portion.

8. The apparatus for closed fluid delivery of claim 5, wherein the first and second portions are movable closer together until interior terminating ends of the first and second portions are in contact.

9. The apparatus for closed fluid delivery of claim 5, wherein the removable collar has a protruding tab, wherein the protruding tab extends circumferentially outwards from the removable collar.

* * * * *